US008653389B2

(12) United States Patent
Liang et al.

(10) Patent No.: US 8,653,389 B2
(45) Date of Patent: Feb. 18, 2014

(54) KEYSWITCH DEVICE, SUPPORTING SEAT AND KEY CAP THEREOF

(75) Inventors: Chen-Yi Liang, New Taipei (TW); Cheng-Hsiang Chuang, New Taipei (TW); Chun-Chien Chen, New Taipei (TW); Shun-De Bai, New Taipei (TW); San-Pao Kao, New Taipei (TW)

(73) Assignee: Wistron Corporation, New Taipei (TW)

( * ) Notice: Subject to any disclaimer, the term of this patent is extended or adjusted under 35 U.S.C. 154(b) by 132 days.

(21) Appl. No.: 13/449,742

(22) Filed: Apr. 18, 2012

(65) Prior Publication Data

US 2012/0285813 A1 Nov. 15, 2012

(30) Foreign Application Priority Data

May 11, 2011 (TW) ..... 100116498 A

(51) Int. Cl.
*H01H 3/12* (2006.01)

(52) U.S. Cl.
USPC ..... 200/341; 400/495

(58) Field of Classification Search
USPC ..... 200/520, 341, 343–345; 400/472, 490, 400/495
See application file for complete search history.

(56) References Cited

U.S. PATENT DOCUMENTS

| | | | | |
|---|---|---|---|---|
| 6,133,539 | A * | 10/2000 | Yao | 200/517 |
| 6,969,815 | B1 * | 11/2005 | Lu | 200/345 |
| 7,462,796 | B1 * | 12/2008 | Chai | 200/341 |
| 8,278,579 | B2 * | 10/2012 | Lin et al. | 200/345 |

FOREIGN PATENT DOCUMENTS

| | | | |
|---|---|---|---|
| CN | 1296278 | A | 11/2000 |
| CN | 2615846 | Y | 5/2004 |
| CN | 101645360 | A1 | 8/2008 |
| CN | 101556872 | A | 10/2009 |

OTHER PUBLICATIONS

Taiwan Office Action in re corresponding Taiwan patent application No. 100116498, dated Aug. 15, 2013; 9 pages.
English translation of sections boxed in red on Taiwan Office Action in re corresponding Taiwan patent application No. 100116498; 2 pages.
English translation of sections boxed in red on CN 2615846Y; 1 page.
English translation of sections boxed in red on CN 101556872A; 1 page.
English translation of sections boxed in red on CN 1296278A; 1 page.
English Abstract, CN 101645360A; Aug. 4, 2008; 4 pages.

* cited by examiner

*Primary Examiner* — Vanessa Girardi
(74) *Attorney, Agent, or Firm* — John A. Fortkort; Fortkort & Houston P.C.

(57) ABSTRACT

A keyswitch device includes a supporting seat, a key cap, a circuit board disposed on the supporting seat, and an elastic member located between the key cap and the circuit board. The supporting seat includes a base board and two first confining members that are formed on the base board and that are spaced apart from each other. The key cap includes a cap body and two first hooks that engage respectively the first confining members, thereby inhibiting the key cap to move in horizontal directions with respect to the supporting seat, and allowing the key cap to move vertically in a range equal to the height of the first blocking parts of the first confining members. When the key cap is moved downward, the elastic member deforms to press the circuit board so as to generate a corresponding signal.

8 Claims, 7 Drawing Sheets

KEYSWITCH DEVICE, SUPPORTING SEAT AND KEY CAP THEREOF

CROSS-REFERENCE TO RELATED APPLICATION

This application claims priority of Taiwanese Application No. 100116498, filed on May 11, 2011, the entire disclosure of which is incorporated herein by reference.

BACKGROUND OF THE INVENTION

1. Field of the Invention

The invention relates to a keyswitch device, more particularly to a keyswitch device that has a stable and relatively flat structure which comprises relatively few components.

2. Description of the Related Art

As shown in FIGS. 1 and 2, an electronic device 9, such as a personal digital assistant, a notebook computer or a keyboard, includes a conventional keyswitch device 90 serving as a command input device. The conventional keyswitch device 90 includes a supporting seat 91, a key cap 92 for pressing, a first balancing member 93 and a second balancing member 94 connected pivotally between the supporting seat 91 and the key cap 92, a circuit board 95, and a resilient dome 96 disposed on the circuit board 95 and having a top surface that is in contact with a bottom surface of the key cap 92.

The supporting seat 91 includes a limiting sleeve 911 and two limiting walls 912, and the key cap 92 includes a shaft 921 extending movably into the limiting sleeve 911 and a block 922 disposed movably between the limiting walls 912. This configuration is for inhibiting horizontal movement and allowing only vertical movement of the key cap 92 relative to the supporting seat 91. The supporting seat 91 further includes a plurality of vertically-extending first hook members 913. Each of the first hook members 913 has a hook end. The keycap 92 further includes a plurality of second hook members 923 for engaging respectively the first hook members so as to prevent separation of the keycap 92 from the supporting seat 91 during the vertical movement of the keycap 92.

When the user presses the key cap 92, the resilient dome 96 is indirectly pressed and subsequently presses the circuit board 95 to generate a corresponding signal. The first and second balancing members 93 and 94 serve to reduce inclination of the key cap 92 when the key cap 92 moves vertically.

As such, the supporting seat 91 and the key cap 92 of the conventional keyswitch device 90 can only be made of plastic or metal by injection molding. Nonetheless, the plastic components must be made with at least a predetermined thickness during the injection molding process in order to maintain a required strength, thereby undesirably increasing the manufacturing cost and the overall height of the keyswitch device 90. A conventional way for increasing the strength of the plastic supporting seat 91 is to laminate an iron sheet on a bottom side of the supporting seat 91, which would further undesirably incur material and labor costs. Metal supporting seat 91 and the keycap 92 by injection molding also have the drawback of relatively high manufacturing cost.

SUMMARY OF THE INVENTION

Therefore, the object of the present invention is to provide a keyswitch device that has a relatively simple structure with a required strength and a relatively low manufacturing cost, and to provide an assembly comprising a supporting seat and a key cap of the abovementioned keyswitch device.

Accordingly, a keyswitch device of the present invention comprises a supporting seat, a key cap, a circuit board disposed on the supporting seat, and an elastic member located between the key cap and the circuit board.

The supporting seat includes a base board and two first confining members that are formed on the base board and that are spaced apart from each other. Each of the first confining members has a first blocking part that extends along a first horizontal direction, two second blocking parts that extend respectively from opposite lateral ends of the first blocking part along a second horizontal direction transverse to the first horizontal direction, and a third blocking part located over the first blocking part and the second blocking parts. The first, second and third blocking parts cooperate with one another to forma retaining space with an opening. The openings of the retaining spaces in the first confining members are configured to face each other or to face away from each other. The key cap includes a cap body and two first hooks that are registered respectively with the first confining members. Each of the first hooks has an extending part that protrudes from a bottom surface of the cap body and an engaging part that protrudes laterally from the extending part. The engaging part of each of the first hooks engages the retaining space of a respective one of the first confining members, thereby inhibiting the key cap to move in the first and second horizontal directions with respect to the supporting seat, and allowing the key cap to move vertically in a range equal to the height of the first blocking parts. When the key cap is moved downward, the elastic member deforms to press the circuit board so as to generate a corresponding signal.

Preferably, the first horizontal direction forms an angle with a longitudinal side of the key cap, the angle being greater than zero degree and smaller than 90 degrees. More preferably, the angle is 45 degrees.

Preferably, the supporting seat further includes two spaced-apart second confining members that are formed on the base board and that are configured to be identical to the first confining members. Each of the second confining member has a first blocking part extending along the second horizontal direction, two second blocking parts extending along the first horizontal direction, and a third blocking part located over the first blocking part and the second blocking parts. The key cap further includes two second hooks that are configured to be identical to the first hooks, and that are registered with the second confining members, respectively.

Preferably, the keyswitch device further comprises a rectangular first balancing member having two free end segments at a longitudinal side of the first balancing member. The supporting seat further includes two spaced-apart first pivoting members, each protruding upwardly from the base board and having a bent end section that extends horizontally. The key cap further includes two spaced-apart second pivoting members disposed on the bottom surface of the cap body. The first balancing member has a portion at an opposite longitudinal side thereof that engages the second pivoting members and that serves as a pivot axis of the first balancing member. The free end segments of the first balancing member engage respectively and are slightly movable in the first pivoting members.

More preferably, the keyswitch device further comprises a rectangular second balancing member shorter than the first balancing member, and having two free end segments at a lateral side of the second balancing member. The supporting seat further includes two spaced-apart third pivoting members, each protruding upwardly from the base board and having a bent end section that extends horizontally. The key cap further includes two spaced-apart fourth pivoting members disposed on the bottom surface of the cap body. The second balancing member has a portion at an opposite lateral side thereof that engages the fourth pivoting members and that serves as a pivot axis of the second balancing member. The free end segments of the second balancing members engage respectively and are slightly movable in the third pivoting members.

The effect of this invention is that since the keyswitch device utilizes a new configuration, and since the supporting seat is made of metal by stamping, the keyswitch device has a relatively small height while maintaining a required strength and stability, and a relatively low manufacturing cost.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
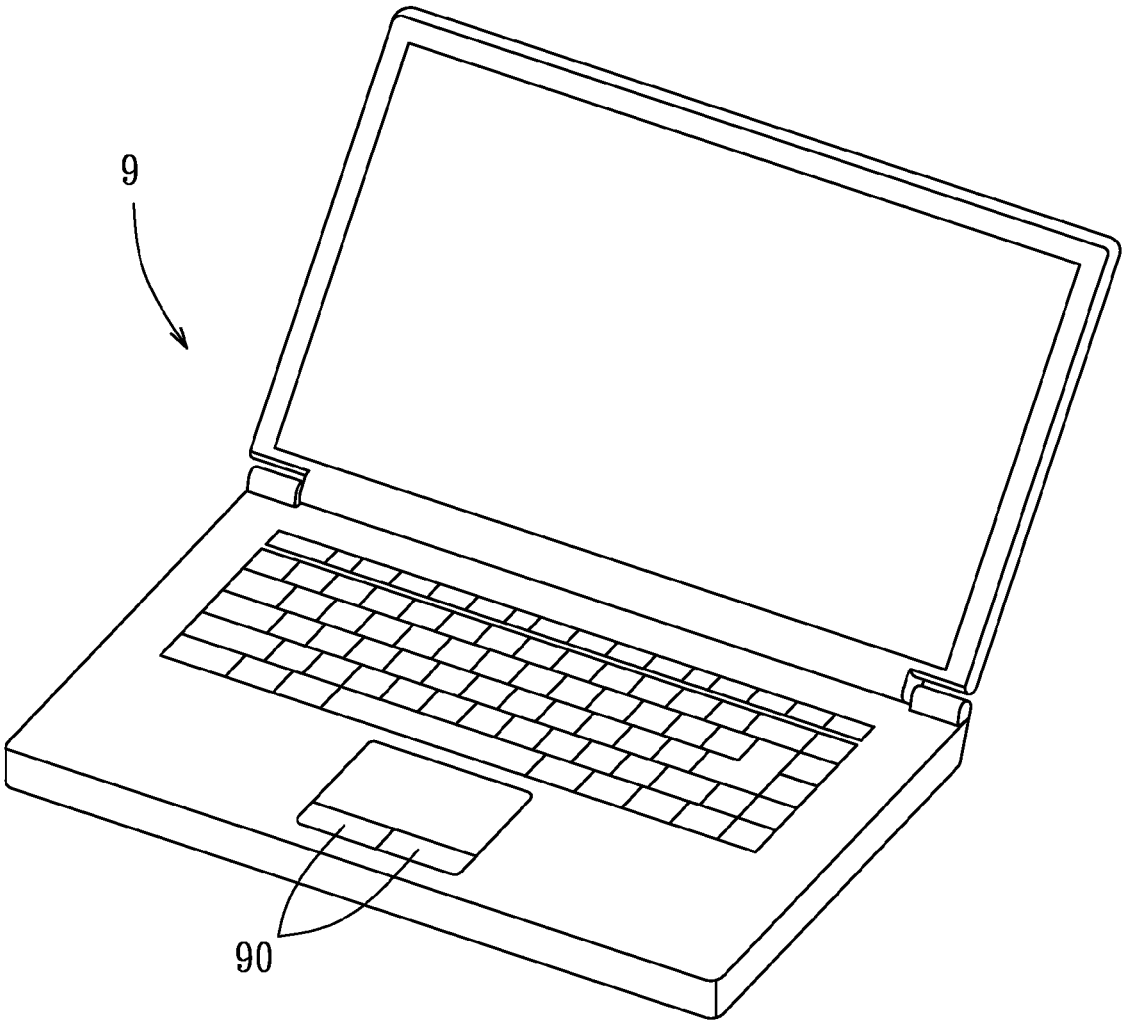
FIG. 1 PRIOR ART
FIG. 1 is a perspective view of an electronic device with a plurality of conventional keyswitch devices.
Figure 2:
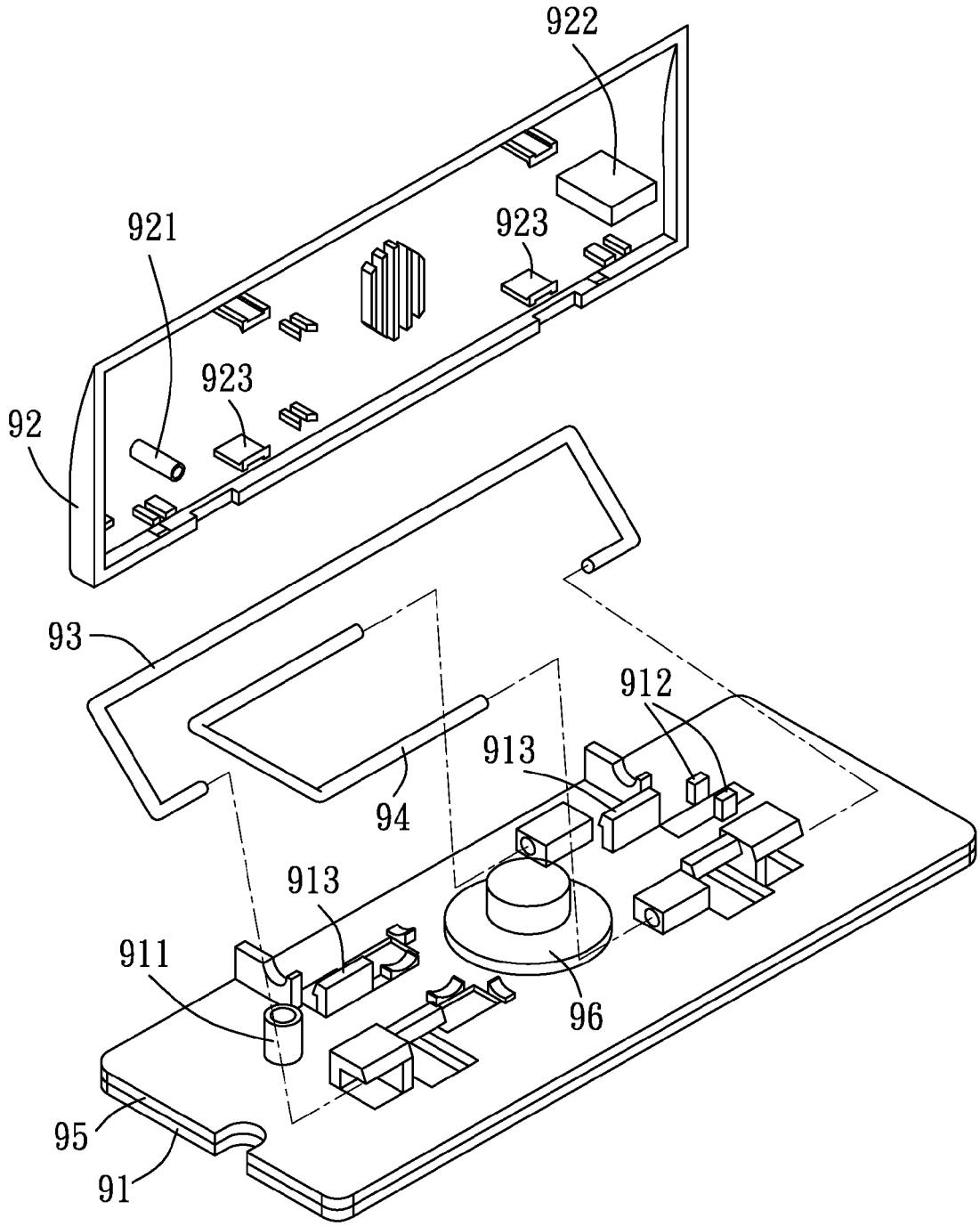
FIG. 2 PRIOR ART
FIG. 2 is an exploded perspective view of the conventional keyswitch device.
Figure 3:
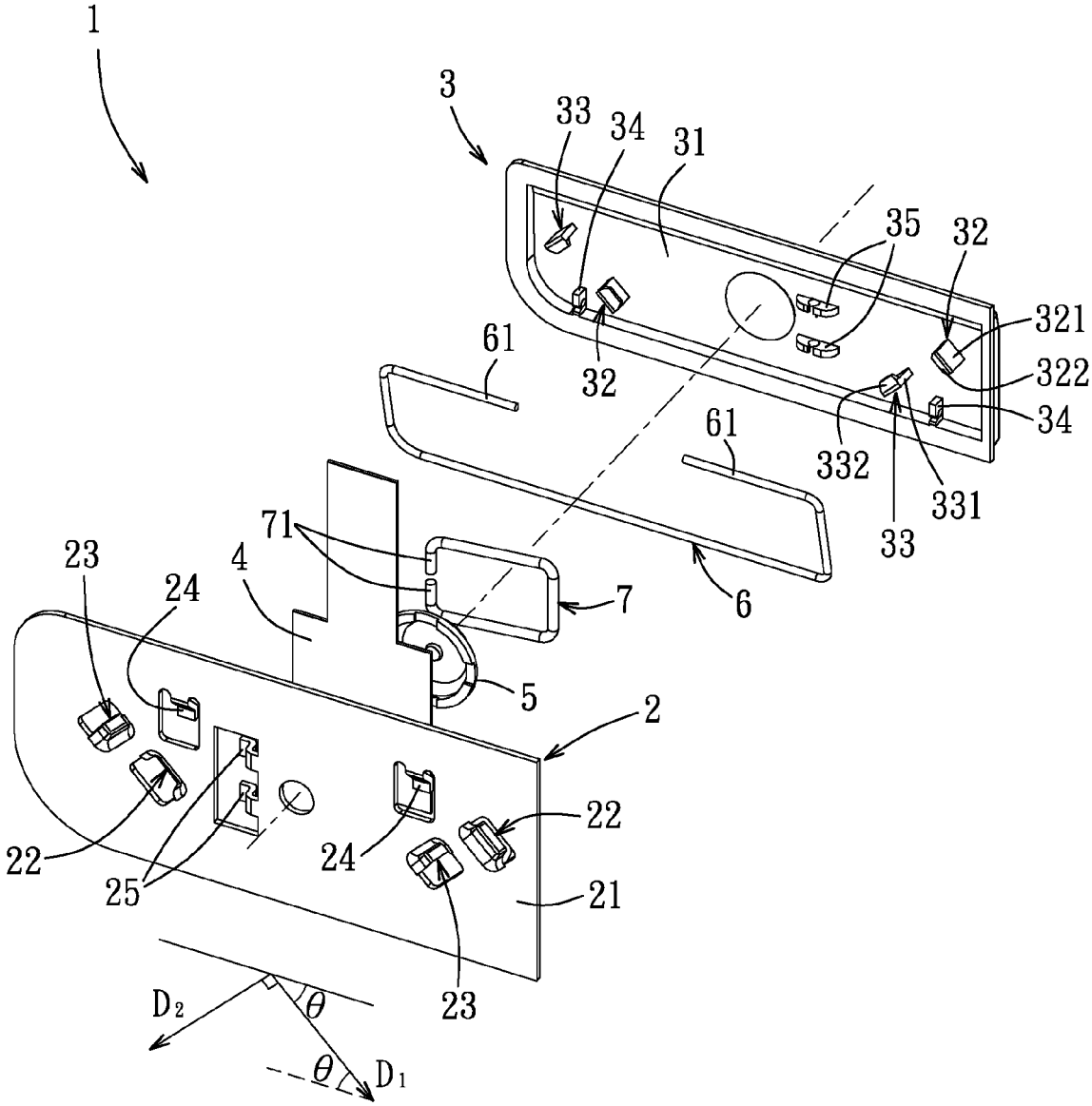
FIG. 3 is an exploded perspective view of an embodiment of a keyswitch device according to the invention.
Figure 4:
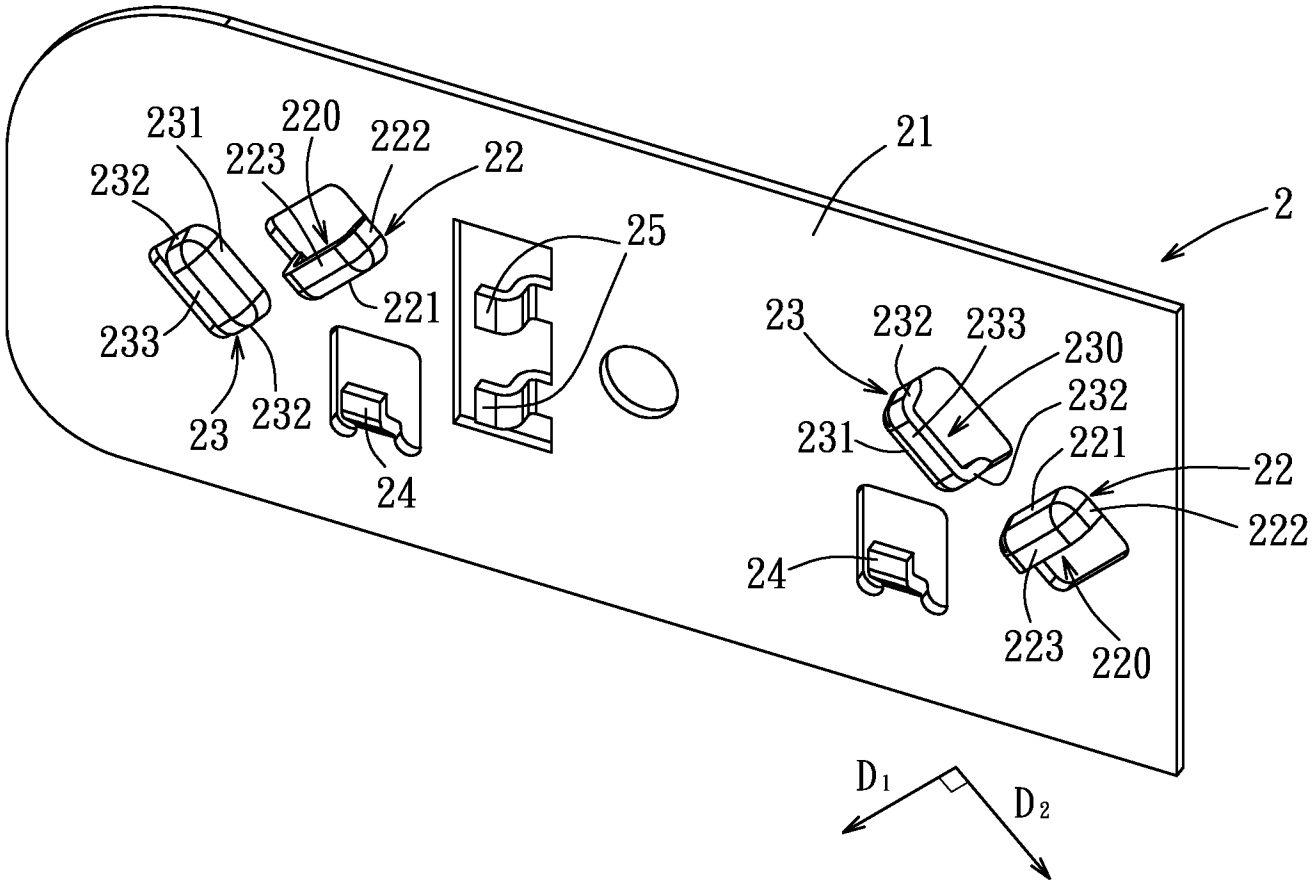
FIG. 4 is a perspective view of a supporting seat of the embodiment.
Figure 6:
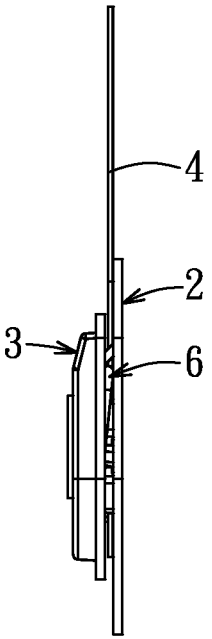
FIGS. 5 to 7 are respectively a schematic top view, a schematic side view and a schematic bottom view of the embodiment.
Figure 5:
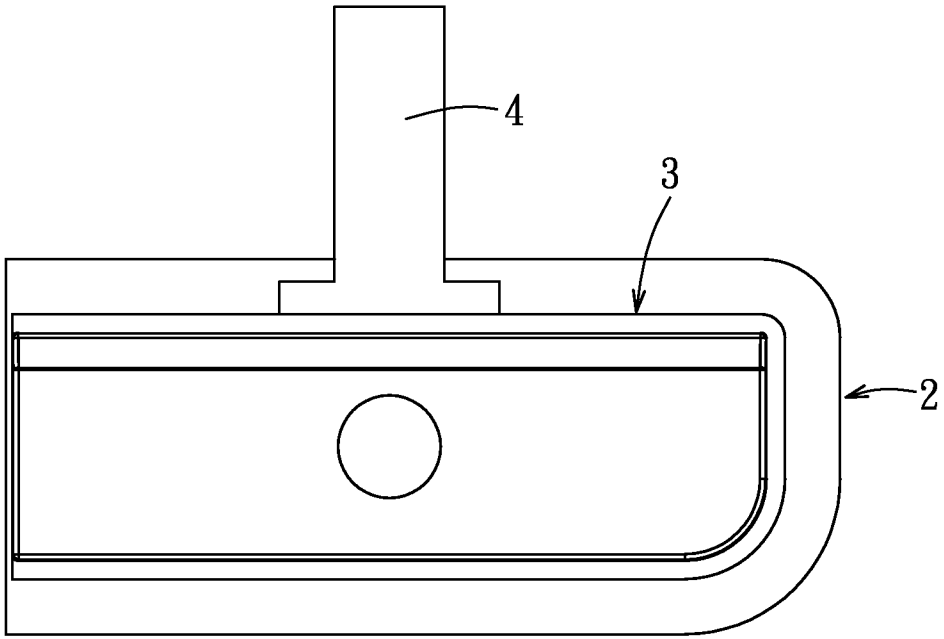

As shown in FIGS. 3 to 6, the embodiment of a keyswitch device 1 according to the present invention comprises a supporting seat 2, a key cap 3, a circuit board 4 disposed on the supporting seat 2, an elastic member 5 located between the key cap 3 and the circuit board 4, a rectangular first balancing member 6 and a rectangular second balancing member 7 that is shorter than the first balancing member 6.

In this embodiment, the supporting seat 2 is made of metal and is formed by a stamping process. The supporting seat 2 includes a base board 21, two spaced-apart first confining members 22 and two spaced-apart second confining members 23 that are formed on the base board 21, and two spaced-apart first pivoting members 24 and two spaced-apart third pivoting members 25. Each of the first pivoting members 24 and the third pivoting members 25 protrudes upwardly from the base board 21 and has a bent end section extending horizontally.

Each of the first confining members 22 has a first blocking part 221 that extends along a first horizontal direction $D_1$, two second blocking parts 222 that extend respectively from opposite lateral ends of the first blocking part 221 along a second horizontal direction $D_2$ transverse to the first horizontal direction $D_1$, and a third blocking part 223 located over the first blocking part 221 and the second blocking parts 222. The first blocking part 221, the second blocking parts 222 and the third blocking part 223 cooperate with one another to form a retaining space with an opening 220. The openings 220 of the retaining spaces in the first confining members 22 are configured to face in the second horizontal direction $D_2$ away from each other, and may be otherwise configured to face in the second horizontal direction $D_2$ toward each other. The first horizontal direction $D_1$ forms an angle θ with a longitudinal side of the key cap 3 (or a longitudinal side of the supporting seat 2 since the outline of the supporting seat 2 corresponds to that of the key cap 3), and the angle θ is 45 degrees. That is, the first confining members 22 and the second confining members 23 are obliquely formed on the base board 21, thus are able to sustain force components of a force exerted thereon in horizontal directions parallel and vertical to the longitudinal side of the supporting seat 2. The angle θ, however, may be any value greater than zero degree and smaller than 90 degrees, and the first confining members 21 can achieve the intended blocking effect with proper size design of the first and second blocking parts 221, 222.

The key cap 3 is made of injection molded plastic, and includes a cap body 31, two first hooks 32 that are registered respectively with the first confining members 22 of the supporting seat 2, two second hooks 33 registered respectively with the second confining members 23, and two spaced-apart second pivoting members 34 and two spaced-apart fourth pivoting members 35 disposed on a bottom surface of the cap body 31.

Each of the first hooks 32 has an extending part 321 that protrudes from the bottom surface of the cap body 31 and an engaging part 322 that protrudes laterally from a distal end of the extending part 321. The engaging part 322 of each of the first hooks 32 engages the retaining space of a respective one of the first confining members 22.

In this embodiment, the engaging parts 322 of the first hooks 32 extend in the second horizontal direction $D_2$ toward each other to engage respectively the retaining spaces of the first confining members 22, and contact respectively the first blocking parts 221 of the first confining members 22, thereby inhibiting the first hooks 32 of the key cap 3 to move in the first horizontal direction $D_1$ with respect to the supporting seat 2. The first hooks 32 and the first confining members 22, however, may be configured alternatively in a manner that the openings 220 of the first confining members 22 face in the first horizontal direction $D_1$ toward each other, and that the engaging parts 322 extend in the second horizontal direction $D_2$ away from each other to engage respectively the retaining spaces of the first confining members 22.

The second blocking parts 222 of the first confining members 22, likewise, are configured to inhibit the first hooks 32 of the key cap 3 to move in the first horizontal direction $D_1$. Thus, engagements between the first hooks 32 and the first confining members 22 have the effect to inhibit the key cap 3 to move in the first and second horizontal directions $D_1$, $D_2$ with respect to the supporting seat 2, and allow the key cap 3 to move vertically in a range equal to the height of the first blocking parts 221. Nevertheless, the second hooks 23 and the second confining members 33 are incorporated in this embodiment so as to obtain a better inhibiting effect for the key cap 3.

Specifically, the second confining members 23 are configured to be identical to the first confining members 22, i.e., each of the second confining members 23 has a first blocking part 231 extending along the second horizontal direction $D_2$, two second blocking parts 232 that extend respectively from opposite lateral ends of the first blocking part 231 along the first horizontal direction $D_1$, and a third blocking part 233 located over the first blocking part 231 and the second blocking parts 232. The first blocking part 231, the second blocking parts 232 and the third blocking part 233 cooperate with one another to form a retaining space with an opening 230. The openings 230 of the retaining spaces are configured to face in the first horizontal direction $D_1$ away from each other. The second hooks 33 are configured to be identical to the first hooks 32. Each of the second hooks 33 has an extending part 331 that protrudes from the bottom surface of the cap body 31 and an engaging part 332 that protrudes laterally from the extending part 331. The second hooks 33 engage the second confining members 23 in a same manner as that of the first hooks 32 engaging the first confining members 22.

Figure 7:
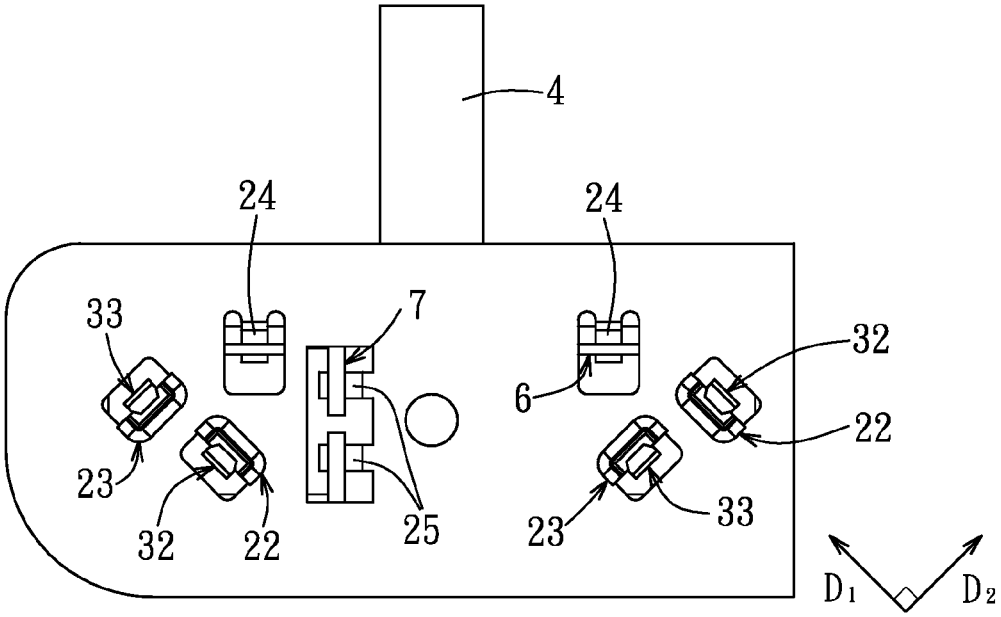
Figure 8:
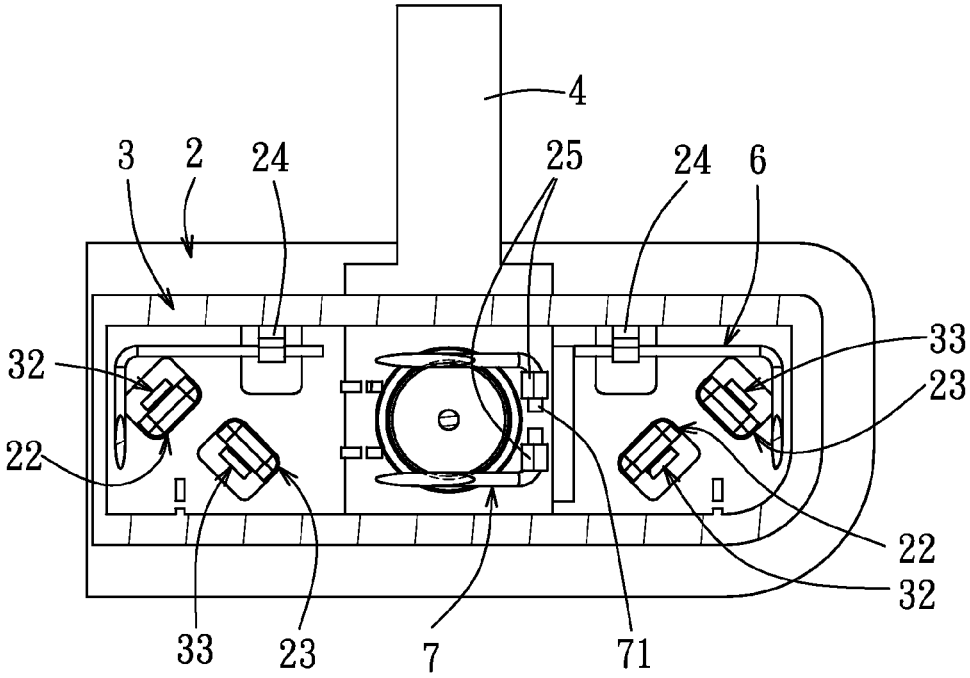
FIG. 8 is a sectional view of the embodiment.

Further referring to FIGS. 7 and 8, the first balancing member 6 is pivoted between the supporting seat 2 and the key cap 3, and has two free end segments 61 at a longitudinal side thereof. Specifically, the first balancing member 6 has a portion at an opposite longitudinal side thereof that engages the second pivoting members 34 and that serves as a pivot axis of the first balancing member 6, and the free end segments 61 of the first balancing member 6 engage respectively and are slightly movable in the first pivoting members 24.

The second balancing member 7 is also configured to be rectangular but is shorter than the first balancing member 6. The second balancing member 7 is pivoted between the supporting seat 2 and the key cap 3, and has two free end segments 71 at a lateral side. Specifically, the second balancing member 7 has a portion at an opposite lateral side thereof that engages the fourth pivoting members 35 and that serves as a pivot axis of the second balancing member 7, and the free end segments 71 of the second balancing member 7 engage respectively and are slightly movable in the third pivoting members 25.

Figure 9:
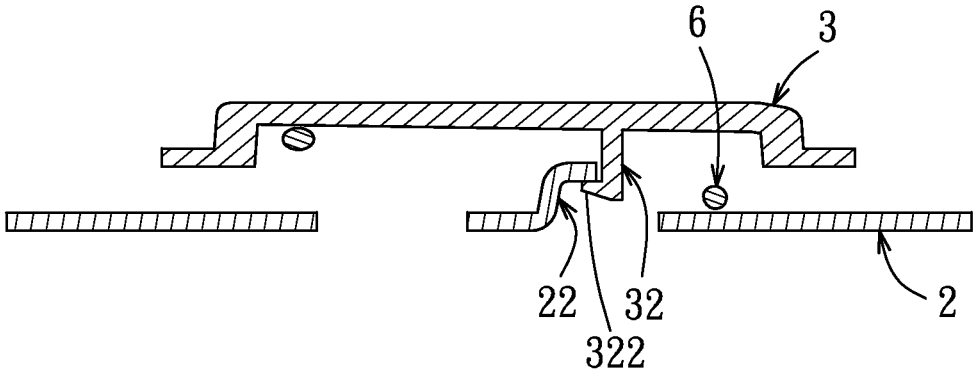
FIGS. 9 and 10 are sectional views illustrating a height variation of the embodiment before and after being pressed.
Figure 10:
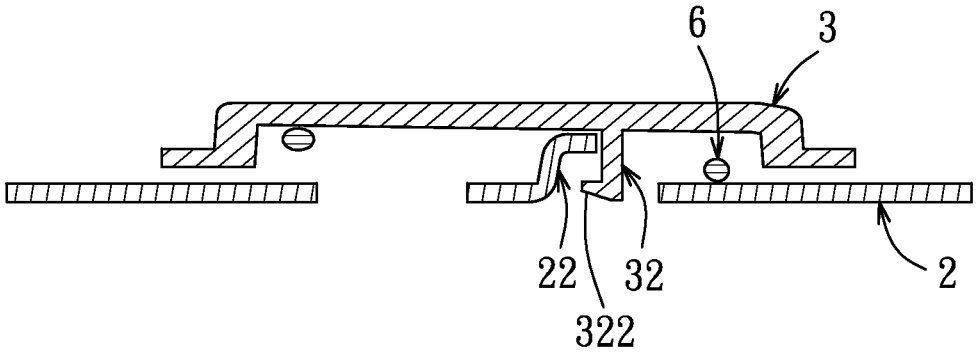

Further referring to FIGS. 9 and 10, when the key cap 3 is pressed to move downward, the first hooks 32 and the second hooks 33 of the key cap 3 move downward with respect to the first confining members 22 and the second confining members 23, and the elastic member 5 deforms to press the circuit board 4 so as to generate a corresponding signal. During this process, the first balancing member 6 and the second balancing member 7 provide stability to the keyswitch device 1 in the longitudinal and lateral directions, respectively.

To sum up, the keyswitch device 1 of this invention utilizes a new configuration, and since the supporting seat 2 is made of metal by stamping, the keyswitch device is relatively flat while maintaining a required strength and stability, and a relatively low manufacturing cost.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A keyswitch device comprising:

a supporting seat including a base board and two first confining members that are formed on said base board and that are spaced apart from each other, each of said first confining members having a first blocking part that extends along a first horizontal direction, two second blocking parts that extend respectively from opposite lateral ends of said first blocking part along a second horizontal direction transverse to the first horizontal direction, and a third blocking part located over said first blocking part and said second blocking parts, said first, second and third blocking parts cooperating with one another to forma retaining space with an opening, said openings of said retaining spaces in said first confining members being configured to face each other or to face away from each other;

a key cap including a cap body and two first hooks that are registered respectively with said first confining members, each of said first hooks having an extending part that protrudes from a bottom surface of said cap body and an engaging part that protrudes laterally from said extending part, said engaging part of each of said first hooks engaging said retaining space of a respective one of said first confining members, thereby inhibiting said key cap to move in the first and second horizontal directions with respect to said supporting seat, and allowing said key cap to move vertically in a range equal to the height of said first blocking parts;

a circuit board disposed on said supporting seat; and an elastic member located between said key cap and said circuit board, and deformed to press said circuit board so as to generate a corresponding signal when said key cap is moved downward.

2. The keyswitch device as claimed in claim 1, wherein said supporting seat is made of metal by stamping.

3. An assembly comprising said supporting seat and said key cap as claimed in claim 1.

4. The keyswitch device as claimed in claim 1, wherein the first horizontal direction forms an angle with a longitudinal side of said key cap, the angle being greater than zero degree and smaller than 90 degrees.

5. The keyswitch device as claimed in claim 4, wherein the angle is 45 degrees.

6. The keyswitch device as claimed in claim 1, wherein:

said supporting seat further includes two spaced-apart second confining members that are formed on said base board and that are configured to be identical to said first confining members;

each of said second confining members has a first blocking part extending along the second horizontal direction, two second blocking parts extending along the first horizontal direction, and a third blocking part located over said first blocking part and said second blocking parts; and said key cap further includes two second hooks that are configured to be identical to said first hooks, and that are registered with said second confining members, respectively.

7. The keyswitch device as claimed in claim 6, further comprising a rectangular first balancing member having two free end segments at a longitudinal side of said first balancing member, wherein:

said supporting seat further includes two spaced-apart first pivoting members, each protruding upwardly from said base board and having a bent end section that extends horizontally;

said key cap further includes two spaced-apart second pivoting members disposed on said bottom surface of said cap body;

said first balancing member has a portion at an opposite longitudinal side thereof that engages said second pivoting members and that serves as a pivot axis of said first balancing member; and said free end segments of said first balancing member engage respectively and are slightly movable in said first pivoting members.

8. The keyswitch device as claimed in claim 7, further comprising a rectangular second balancing member shorter than said first balancing member, and having two free end segments at a lateral side of said second balancing member, wherein:

said supporting seat further includes two spaced-apart third pivoting members, each protruding upwardly from said base board and having a bend end section that extends horizontally;

said key cap further includes two spaced-apart fourth pivoting members disposed on said bottom surface of said cap body;

said second balancing member has a portion at an opposite lateral side thereof that engages said fourth pivoting members and that serves as a pivot axis of said second balancing member; and said free end segments of said second balancing members engage respectively and are slightly movable in said third pivoting members.

* * * * *